US005547384A

United States Patent [19]

Benjamin

[11] Patent Number: 5,547,384

[45] Date of Patent: Aug. 20, 1996

[54] ELECTRICAL CONNECTOR WITH SURFACE MOUNT CONTACTS

[75] Inventor: Karen E. Benjamin, Harrisburg, Pa.

[73] Assignee: The Whitaker Corporation, Wilmington, Del.

[21] Appl. No.: 575,233

[22] Filed: Dec. 20, 1995

Related U.S. Application Data

[63] Continuation of Ser. No. 234,907, Apr. 28, 1994, abandoned.

[51] Int. Cl.[6] ..... H01R 9/09

[52] U.S. Cl. ..... 439/79; 439/83

[58] Field of Search ..... 439/79, 78, 72, 439/80, 81, 82, 83

[56] References Cited

U.S. PATENT DOCUMENTS 3,409,862 11/1968 Lynch et al. ..... 439/79 X 4,802,860 2/1989 Kikuta ..... 439/79 OR 5,346,404 9/1994 Shimada ..... 439/79 X 5,354,207 10/1994 Chikano ..... 439/79 OR 5,366,381 11/1994 Kile ..... 439/79 OR

*Primary Examiner*—P. Austin Bradley

*Assistant Examiner*—Daniel Wittels

*Attorney, Agent, or Firm*—Anton P. Ness

[57] ABSTRACT

An electrical contact (3) comprises, a body portion (7) for mounting in an insulating housing (2), a solder tail (4), and tool impinging surfaces (9, 10) on the solder tail (4) facing in opposite directions to engage respective tools (11, 12) to bend the solder tail (4) relative to the body portion (7).

11 Claims, 5 Drawing Sheets

ELECTRICAL CONNECTOR WITH SURFACE MOUNT CONTACTS

This application is a continuation of application Ser. No. 08/234,907 filed, Apr. 28, 1994 now abandoned.

FIELD OF THE INVENTION

The invention relates to an electrical contact adapted for mounting in an electrical connector, and adapted with a surface mount tail required to be in precise alignment.

BACKGROUND OF THE INVENTION

A known electrical connector, according to U.S. Pat. No. 5,186,633, comprises, an insulating housing and electrical contacts in the housing, and solder tails on the contacts that are connected to circuit traces on a circuit board by solder reflow connections. Solder reflow connections are accomplished by engaging the solder tails against solidified solder covering the circuit traces, followed by reflowing the solder to a molten state. The reflowed solder is then solidified to join the solder tails with the circuit traces.

Effective solder joints are assured by positioning the solder tails in coplanar alignment with one another prior to solder reflow. According to the disclosure of U.S. Pat. No. 5,186,633, coplanar alignment of the solder tails is assured because the solder tails are resiliently deflected when they are pressed against the circuit board. The pressed contacts resiliently deflect into coplanar alignment. U.S. Pat. No. 5,129,832, discloses bending of contacts projecting from a connector housing. Again, the contacts are pressed against a circuit board.

According to U.S. Pat. No. 5,194,017, surface mount contacts comprise surface mount contact surfaces along edges of nonresilient plates. Because the plates are nonresilient, they are difficult to align in a connector housing such that the surface mount contacts remain in coplanar alignment with one another.

SUMMARY OF THE INVENTION

According to an aspect of the invention, a surface mount solder tail on an electrical contact is provided with at least one tool impinging surface to engage a tool while being bent to register the surface mount contact surface in precise position. The contact is adapted to be bent to a precise position while projecting outwardly from a housing of an electrical connector.

An advantage of the invention resides in an electrical contact that can be bent to align a surface mount contact surface of the contact into precise predetermined position, for example, coplanar with surface mount contact surfaces on multiple electrical contacts.

According to an embodiment of the invention, a tool impinging surface on the surface mount solder tail controls bending of the solder tail to a predetermined position.

DESCRIPTION OF THE DRAWINGS

Embodiments of the invention will now be described with reference to the accompanying drawings, according to which.

DETAILED DESCRIPTION

Figure 1:
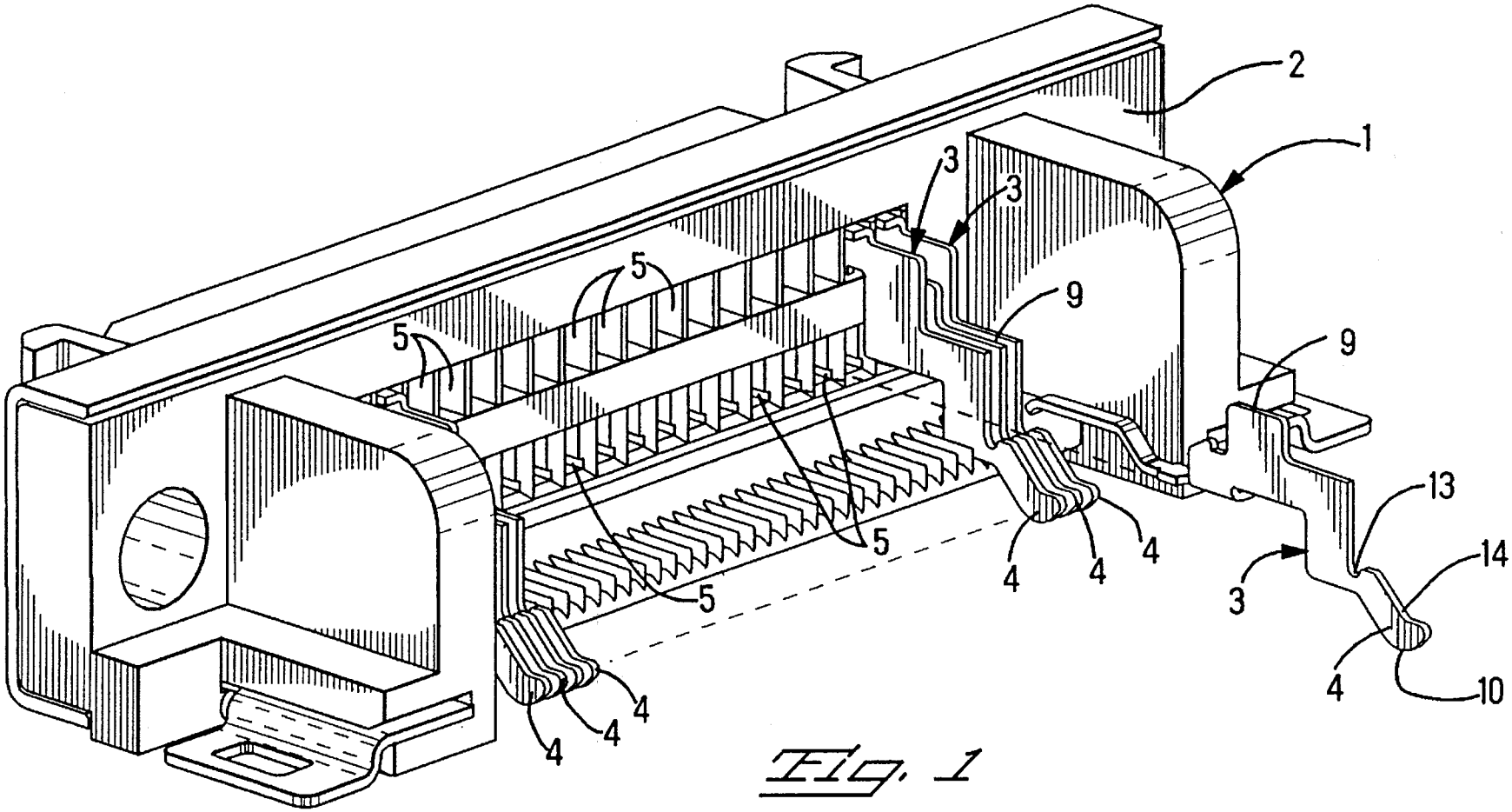
FIG. 1 is an isometric view of an electrical connector with one of multiple electrical contacts separated from a housing of the connector.
Figure 2:
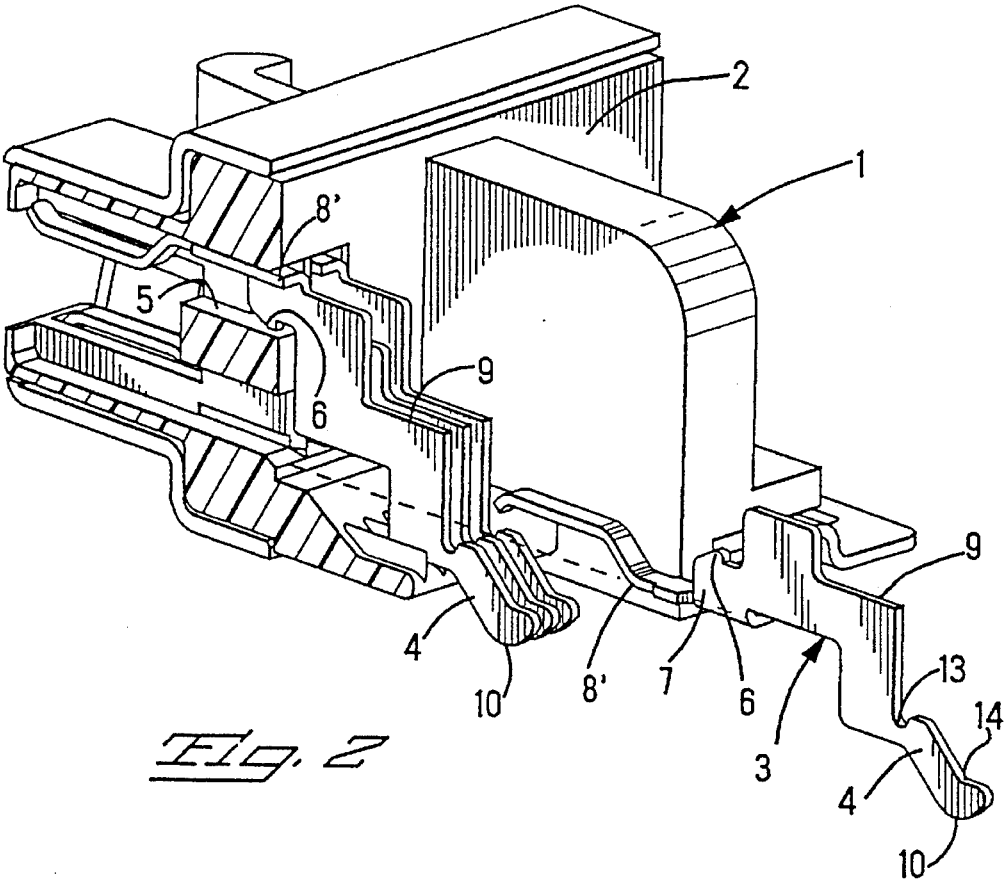
FIG. 2 is an isometric view of an electrical connector as shown in FIG. 1 with parts cut away, and with an electrical contact separated from a housing of the connector.
Figure 3:
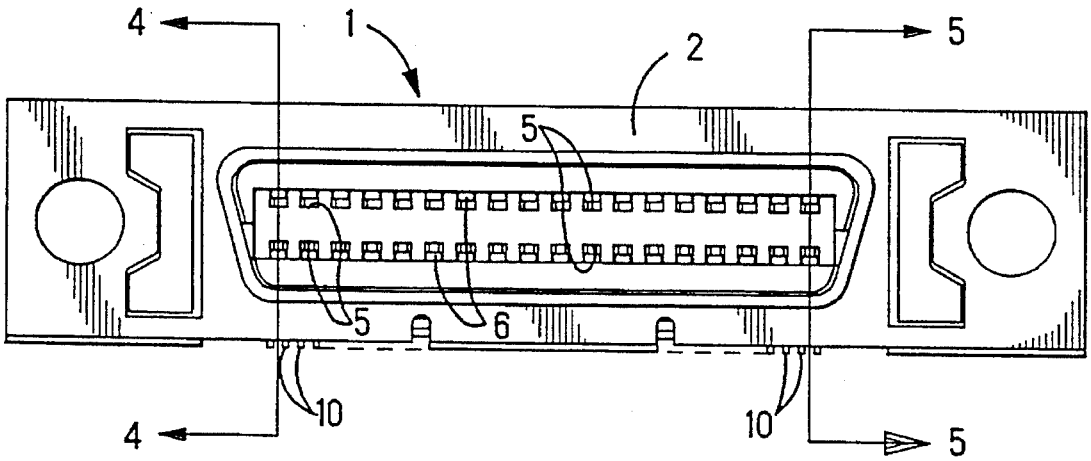
FIG. 3 is front elevation view of the connector as shown in FIG. 1.
Figure 4:
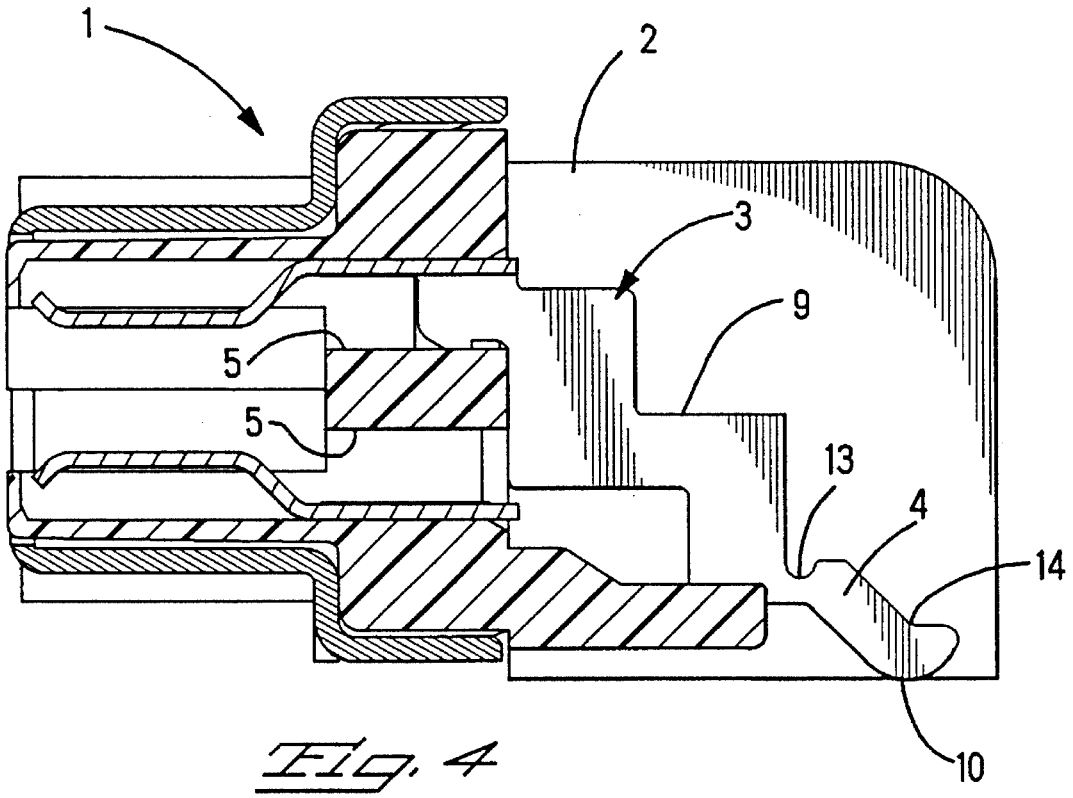
FIG. 4 is a section view taken along the line 4—4 of FIG. 3.
Figure 5:
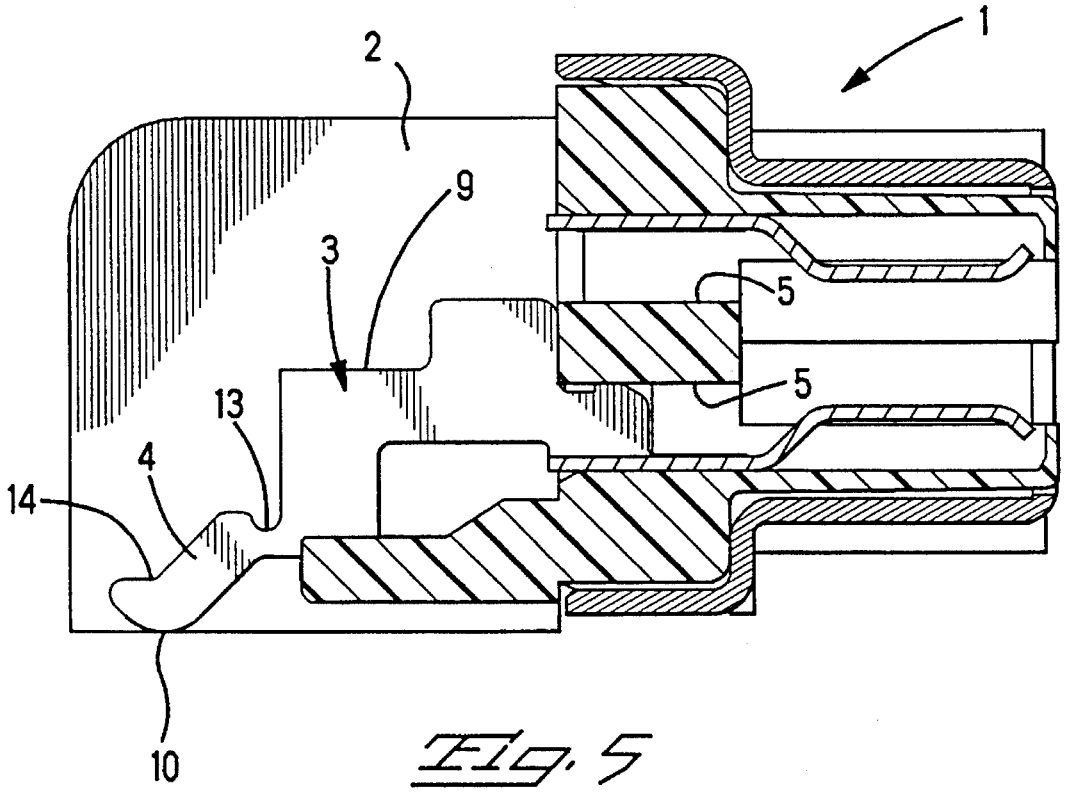
FIG. 5 is a section view taken along the line 5—5 of FIG. 3.

With reference to FIG. 1 of the drawings, an electrical connector Z comprises, a unitary insulating housing 2 and electrical contacts 3 in the housing 2, and solder tails 4 on the contacts 3 projecting outwardly from the housing 2. The contacts 3 in an upper row of contact cavities 5 and the contacts 3 in a lower row of contact cavities 5 have respective solder tails 4 alternating with one another in a single row of the solder tails 4.

With reference to FIGS. 2–5 each contact 3 is of unitary construction stamped and formed from a flat metal plate having a plane of thickness. A raised knob 6 on a body 7 of the contact 3 is adapted to register in a respective contact receiving cavity 5 of the housing 2. An electrical contact portion 8 projects forwardly from the body 7 along the contact receiving cavity 5. A curved contact finger 8' extends forwardly of the body 7. The contact finger 8' is initially within the plane of thickness of the body, and is bent to project alongside said body 7. The contact finger 8' and the knob 6 register against opposite walls of one of the cavities 5 with an interference fit.

The solder tails 4 are metal plates oriented perpendicular to the board-mount or lower surface of the housing and thus would be perpendicular to the circuit board. Straight edges 9 on top sides of the plates comprise upper, tool impinging surfaces on the solder tails 4. Lower, tool impinging surfaces 10 on the solder tails 4 comprise curved edges on undersides of the plates. The tool impinging surfaces 9, 10 on each solder tail 4 face in opposite directions. The tool impinging surfaces 9, 10 on each solder tail 4 are within the thickness plane of the plate that extends between one of the surfaces 10 and one of the tool impinging surfaces 9.

The lower, tool impinging surfaces 10 further comprise surface mount contact surfaces on undersides of the plates. These surface mount contact surfaces are to be connected by solder joints, not shown, to circuit traces, not shown, on a circuit board, not shown. Effective solder joints are assured by positioning the solder tails in precise alignment with the connector 2 and with one another prior to connection to the circuit traces. The embodiments of the invention are adapted with the solder tails 4 that can be bent into said precise alignment while they project from the housing 2.

Figure 6:
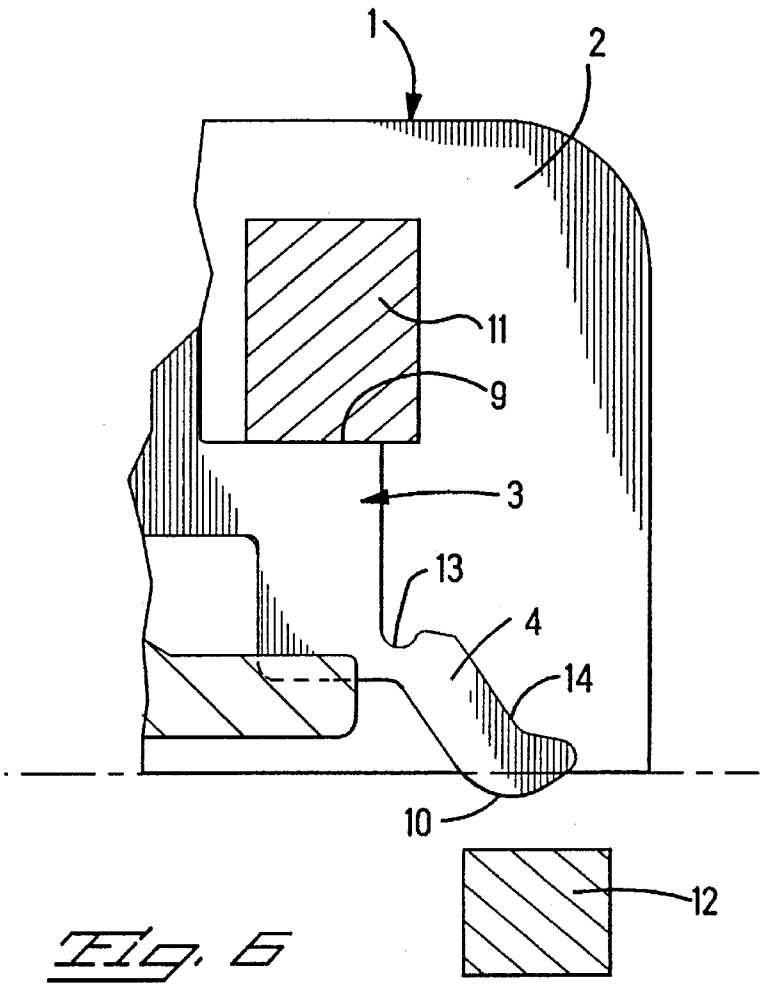

With reference to FIG. 6, the contacts 3 are stamped and formed such that the solder tails 4 project from the housing 2 to an initial position downwardly and slightly below a desired position that constitutes precise alignment. The precise alignment is illustrated by a centerline in FIGS. 6, 7 and 8.

Figure 7:
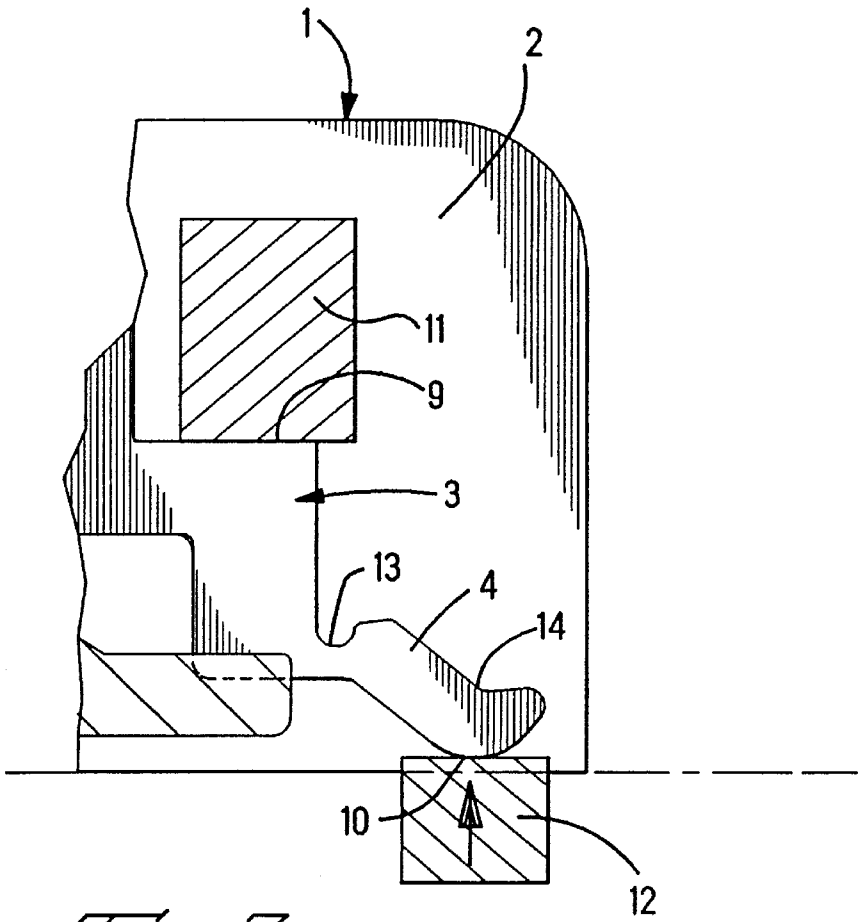
FIGS. 6, 7 AND 8 are fragmentary views of the connector as shown in FIG. 1 with jaws of a tool causing movement of a solder tail on one of the contacts to a precise location.
Figure 8:
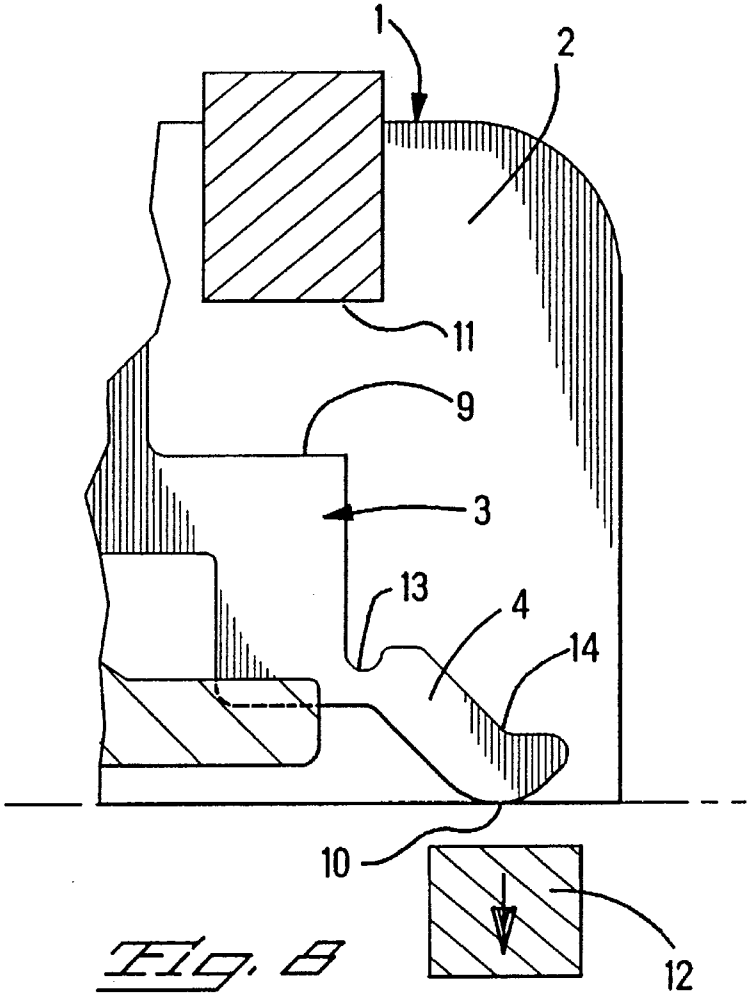

According to a procedure that will now be described, the solder tails 4 are bent upward with respect to remainders of the contacts 3 to a slightly elevated position of precise alignment, whereby the curved surfaces 10 are in coplanar alignment with one another and are then left tangent to the centerline. Bending of the solder tails 4 of the contacts 3 will now be described, by way of example, referring to one of the solder tails 4. With reference to FIGS. 6,7 and 8, one of the solder tails 4 on one of the contacts 3 projects at a lower position than desired. The solder tail 4 is shown as being bent to a precise alignment by tools 11, 12. The tools 11, 12 comprise opposed jaws. For example, the upper tool 11 can be an anvil of a force applying press, not shown. The upper tool 11 engages against the straight edge 9, while the lower tool 12 can be a moveable ram of the press that engages the surface 10 of the solder tail 4. The upper tool 11 has a straight edge that is impinged by the upper, tool impinging surface 9 on each of the solder tails 4 to control bending of the solder tail 4 upwardly into a predetermined position. The lower tool 12 is moved upwardly while engaged against the surface 10 of the solder tail 4.

The solder tail 4 of each contact 3 will bend relative to the body portion 7 and a remainder of the contact 4, and will move to a precise alignment determined by the final positions of the tools 11, 12 while they remain engaged on opposite facing surfaces 9, 10 of each of the solder tails 4. The tool engaging surfaces 9, 10 are rigid and nondeformable. A neck 13 on the solder tail 4 is a narrow portion that is spaced between the upper tool impinging surface 9 and the lower, tool impinging surface 10, and concentrates bending stresses. Bending deformation of the solder tail 4 occurs at the narrow neck 13, due to stress concentration, rather than elsewhere on the contact 3. The plate construction of the contact 3 is broader in the plane of thickness, than the plate thickness on both sides of the neck 13, thereby, stiffening the solder tail 4 to reduce movement of the contact 3 due to spring back deflection of the contact 3 due to stored spring energy. Some spring back deflection occurs. Accordingly, each solder tail 4 is bent slightly beyond the desired position indicated by the centerline in FIG. 7. When the tools 11, 12 release the solder tail 4 subsequent to bending of the solder tail 4, FIG. 8, the solder tail will undergo slight spring back deflection to the desired position indicated by the surface 10 being tangent to the centerline in FIG. 8. The lower tool engaging surfaces 10 of the solder tails 4 further comprise surface mount contact surfaces on the solder tails 4 that are in coplanar alignment with one another, and positioned accurately relative to the remainder of the connector 1, due to the solder tails 4 having been bent while projecting outwardly from the housing 2. The solder tails 4 have been bent to align the surface mount contact surfaces coplanar with one another prior to engagement with circuit traces, not shown, of a circuit board, not shown.

The force fit contacts 3 shift slightly to different positions in the contact receiving cavities 6, as result of the bending forces applied to the contacts 3 by the tools 11, 12. This shifting of the contacts 3 to new force fit positions in the cavities 6 relieves internal stresses in the contacts 3 which would have contributed to spring back of the contacts 4 to less predictable positions.

Figure 9:
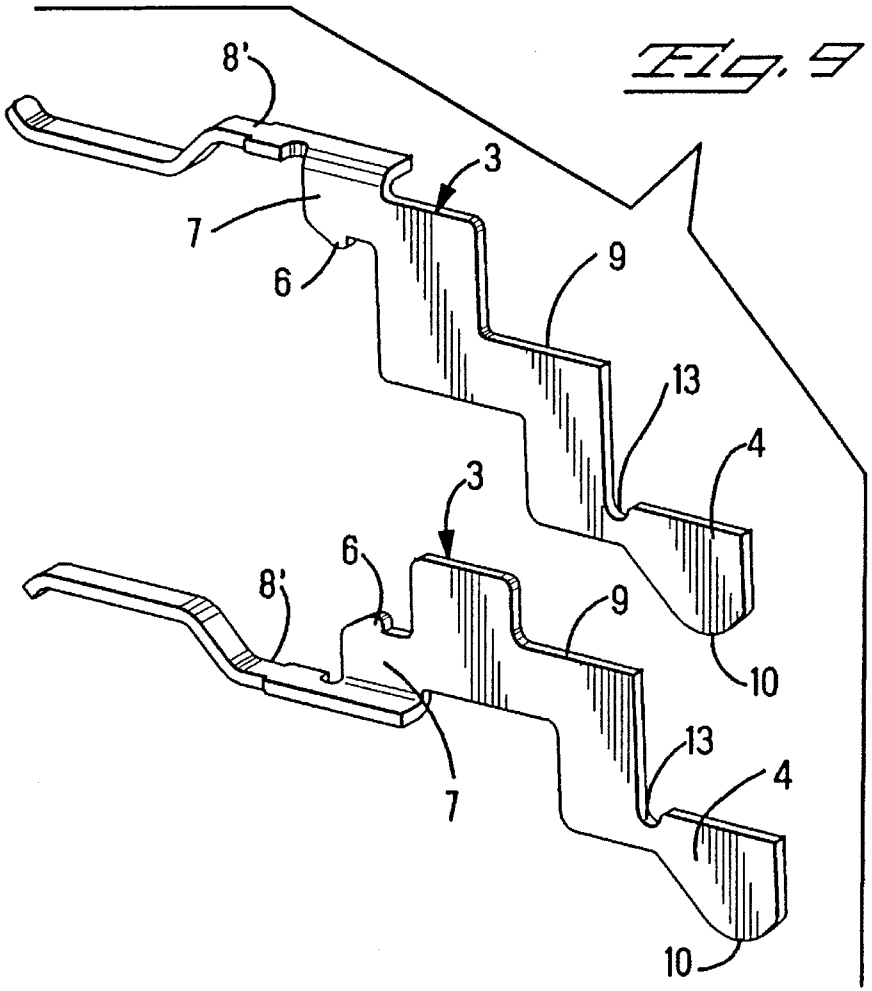
FIG. 9 is an isometric view of two electrical contacts having solder tails.

Each solder tail 4 comprises a recessed edge 14 extending along a tip of the solder tail 4 to reduce the profile of the solder tail 4 for visual inspection, particularly to inspect a solder joint that joins the solder tail 4 to a circuit trace. The thickness of the solder tail is sufficiently massive despite having the recessed edge 14 to minimize spring back energy being stored when the solder tail 4 is bent. An alternative shape of the solder tail 4, FIG. 9, provides an even more massive solder tail of plate construction.

An advantage of the above described embodiment resides in an electrical contact having tool impinging surfaces on the solder tail facing in opposite directions to engage respective tools to bend the solder tail relative to a body portion of the contact.

Another advantage of the above described embodiment resides in an electrical connector having electrical contacts with solder tails that are bent to register surface mount contact surfaces on the tails in a precise position while projecting from a housing of the connector.

Another advantage is that the solder tail of all the contacts have the same geometry to enable the same tools to bend all the solder tails at the same time.

I claim:

1. An electrical connector comprising:

an insulating housing and electrical contacts in the housing, solder tails on the contacts projecting outwardly from the housing, surface mount contact surfaces on the solder tails initially depending beyond a board-mounting surface of said housing and beyond a plane appropriate for engagement and electrical connection with corresponding contact surfaces of a circuit board, each contact being provided with a neck spaced from the corresponding surface mount contact surface, said neck being reduced in dimension from adjacent portions of said contact to concentrate bending stresses, to enable deformation of said solder tail at said neck by tooling to register said surface mount contact surfaces of all said solder tails into coplanarity for engagement and electrical connection with corresponding pads of a circuit element.

2. An electrical connector as recited in claim 1 wherein the solder tails are metal plates, and the surface mount contact surfaces comprise edges of the plates, and said plates further comprise upper and lower tool impinging edge surfaces facing in opposite directions and exposed outwardly of said housing for engagement by tooling for alignment of said surface mount contact surfaces, said upper and lower tool impinging surfaces being spaced along said solder tail on respective sides of said neck.

3. An electrical connector as recited in claim 1, and further comprising: a recessed edge along a tip of each solder tail to reduce the profile of the solder tail for easier visual inspection, the recessed edge and the surface mount contact surface comprising respective edges of the solder tail.

4. An electrical connector comprising:

an insulating housing, electrical contacts in the housings solder tails on the contacts projecting outwardly of the housing and extending beyond a board-mounting surface of said housing for surface mount contact surfaces of said solder tails to initially extend beyond a plane appropriate for engaging and being electrically connected to corresponding pads on a circuit board mounting surface, and upper and lower tool impinging surfaces on each of the solder tails facing in opposite directions and exposed outwardly from said housing to be engaged by respective tool surfaces to be deformable bent thereby to register the surface mount contacts coplanar with one another while projecting outwardly from the housing for said surface mount contact portions of said solder tails to then be disposed in a plane appropriate for engaging and being electrically connected to said circuit board pads.

5. An electrical connector as recited in claim 4 wherein, one of the tool impinging surfaces on each contact comprises a surface mount contact surface.

6. An electrical connector as recited in claim 4 and further comprising necks on the solder tails having reduced dimensions from adjacent solder tail portions and being positioned between said upper and lower tool impinging surfaces to concentrate bending stresses between said upper and lower tool impinging surfaces to control deformation of said solder tail for alignment of said surface mount contact portions with respect to body portions of said contacts within said housing.

7. An electrical connector as recited in claim 5 wherein, the solder tails are metal plates, and the surface mount contact surfaces and the tool impinging surfaces comprise edges of the plates.

8. An electrical connector as recited in claim 4, and further comprising: a recessed edge along a tip of the solder tail to reduce the profile of the solder tail for easier visual inspection.

9. An electrical contact comprising:

a body portion for mounting in an insulating housing, a mating end on the body portion and a solder tail projecting outwardly from the body portion, a neck spaced along said solder tail inwardly from an end thereof, said neck having a sufficiently reduced dimension from adjacent portions of said solder tail to concentrate bending stresses thereat, and upper and lower tool impinging surfaces on the solder tail on respective sides of said neck and facing in opposite directions to be engaged by respective tool surfaces, whereby the contact is adapted to enable controllable deformation by tooling at said neck to adjust the position of the solder tail relative to the body portion to register a surface mount contact surface adjacent said end into a plane appropriate for engagement and electrical connection with a contact pad of a circuit board.

10. An electrical contact as recited in claim 9 wherein, the solder tail comprises a plate, and the tool impinging surfaces are edges of the plate.

11. An electrical contact as recited in claim 9 wherein, one of the tool impinging surfaces comprises a surface mount contact surface.

* * * * *